United States Patent [19]

Dill

[11] Patent Number: 4,989,866

[45] Date of Patent: Feb. 5, 1991

[54] ADJUSTABLE BATTING TEE

[76] Inventor: David N. Dill, 2314 Vance Dr., Florence, S.C. 29501

[21] Appl. No.: 475,234

[22] Filed: Feb. 5, 1990

[51] Int. Cl.[5] ..... A63B 69/40

[52] U.S. Cl. ..... 273/26 R; 273/29 A

[58] Field of Search ..... 273/26 R, 26 A, 29 R, 273/29 A, 200 R, 184 B, 197 R, 196, 185 D

[56] References Cited

U.S. PATENT DOCUMENTS

| | | | |
|---|---|---|---|
| 4,445,685 | 5/1984 | Cardlieri | 273/26 R |
| 4,533,138 | 8/1985 | Rodriguez | 273/26 R |
| 4,575,080 | 3/1986 | Miles | 273/26 R |
| 4,664,374 | 5/1987 | Groves | 273/26 R |

*Primary Examiner*—Theatrice Brown

*Attorney, Agent, or Firm*—Leon Gilden

[57] ABSTRACT

An apparatus including a baseball "home" plate orthogonally mounting a first vertical support that rotatably mounts a "T" shaped conduit, wherein the "T" shaped conduit adjustably receives a vertical tube therethrough. The vertical tube extends forwardly into a further "T" shaped conduit that adjustably mounts a vertical tube therethrough. The vertical tube mounts a resilient sleeve thereon, with the resilient sleeve frictionally receiving a baseball mounting the rigid sleeve therewithin, wherein the upper end of the rigid sleeve is of an arcuate configuration to accommodate a baseball thereon. A pair of spaced abutment rods are mounted forwardly and to each side of the first vertical support post to limit pivotment of the horizontal tube to approximately 120 degree.

8 Claims, 4 Drawing Sheets

PRIOR ART 10
11
12
13
14
15
16
17
18
19
20
21
22
23
24
25
26
27
29

ADJUSTABLE BATTING TEE

BACKGROUND OF THE INVENTION

1. Field of the Invention

The field of invention relates to batting tee apparatus, and more particularly pertains to a new and improved adjustable batting tee wherein the same accommodates batting practice forwardly and rotatably in an adjustable manner relative to a "home" plate to enhance a batter's practice thereof.

2. Description of the Prior Art

Batting tees of various types are utilized in the prior art. Heretofore, however, prior art batting tees have failed to provide the ease and field of adjustment as does the instant invention, which readily and adjustably positions an associated baseball in a predesired vertical and angular orientation relative to an individual attempting batting practice. Examples of the prior art include U.S. Pat. No. 4,681,318 to Lay wherein the batting tee is provided with a fixedly mounted support post including a resilient coil spring to accommodate flexure of the post during batting practice.

U.S. Pat. No. 4,796,885 to Wright provides a post section mounted to a slide, wherein the slide is pivotally and slidably mounted to a "home" plate. The adjustment of the Wright patent is typical of the prior art devices requiring undue attention to adjustment thereof.

Similary, U.S. Pat. No. 4,709,924 to Wilson, et al., provides a batting tee of similar configuration and structure to that of the Wright patent without associated detail to a resilient sleeve utilized by the Wright patent.

U.S. Pat. No. 4,445,685 to Cardieri provides a batting tee practice organization wherein the same utilizes a multi-plate arrangement to accommodate a batting tee of the organization relatively structurally remote from the instant invention.

U.S. Pat. No. 4,664,374 to Groves provides an adjustable batting tee organization wherein the planar base includes an attachment member to provide support to a slide member mounted thereon, wherein the slide member mounts a multi-post support for positioning of baseballs thereon.

As such, it may be appreciated that there is a continuing need for a new and improved adjustable batting tee apparatus wherein the same addresses both the problems of ease of use and effectiveness in construction in enabling an individual to adjustably position a baseball relative to a "home" plate member and in this respect, the present invention substantially fulfills this need.

SUMMARY OF THE INVENTION

In view of the foregoing disadvantages inherent in the known types of batting tee structures now present in the prior art, the present invention provides an adjustable batting tee apparatus wherein same readily and conveniently provides arcuate and vertical adjustment of a support for a baseball during a batting practice. As such, the general purpose of the present invention, which will be described subsequently in greater detail, is to provide a new and improved adjustable batting tee apparatus which has all the advantages of the prior art batting tee structures and none of the disadvantages.

To attain this, the present invention provides an apparatus including a baseball "home" plate orthogonally mounting a first vertical support that rotatably mounts a "T" shaped conduit, wherein the "T" shaped conduit adjustably receives a vertical tube therethrough. The vertical tube extends forwardly into a further "T" shaped conduit that adjustably mounts a vertical tube therethrough. The vertical tube mounts a resilient sleeve thereon, with the resilient sleeve frictionally receiving a baseball mounting the rigid sleeve therewithin, wherein the upper end of the rigid sleeve is of an arcuate configuration to accommodate a baseball thereon. A pair of spaced abutment rods are mounted forwardly and to each side of the first vertical support post to limit pivotment of the horizontal tube to approximately 120 degrees.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved adjustable batting tee apparatus which has all the advantages of the prior art batting tee structures and none of the disadvantages.

It is another object of the present invention to provide a new and improved adjustable batting tee apparatus which may be easily and efficiently manufactured and marketed.

It is a further object of the present invention to provide a new and improved adjustable batting tee apparatus which is of a durable and reliable construction.

An even further object of the present invention is to provide a new and improved adjustable batting tee apparatus which is susceptible of a low cost of manufacture with regard to both materials and labor, and which accordingly is then susceptible of low prices of sale to the consuming public, thereby making such adjustable batting tee apparatus economically available to the buying public.

Still yet another object of the present invention is to provide a new and improved adjustable batting tee apparatus which provides in the apparatuses and methods of the prior art some of the advantages thereof, while simultaneously overcoming some of the disadvantages normally associated therewith.

Still another object of the present invention is to provide a new and improved adjustable batting tee apparatus wherein the same vertically and arcuately positions a support post for a baseball to accommodate variations in physical portions of individuals during a batting practice, and further enables positioning of a baseball relative to a "home" plate structure to effectively simulate positions of a baseball encountered during a baseball game.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
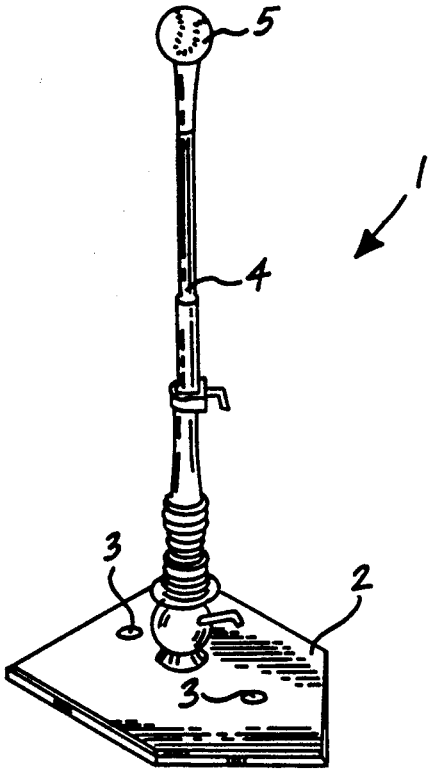
FIG. 1 is an isometric illustration of a prior art batting tee apparatus.

With reference now to the drawings, and in particular to FIGS. 1 to 6 thereof, a new and improved adjustable batting tee apparatus embodying the principles and concepts of the present invention and generally designated by the reference numeral 10 will be described.

Figure 2:
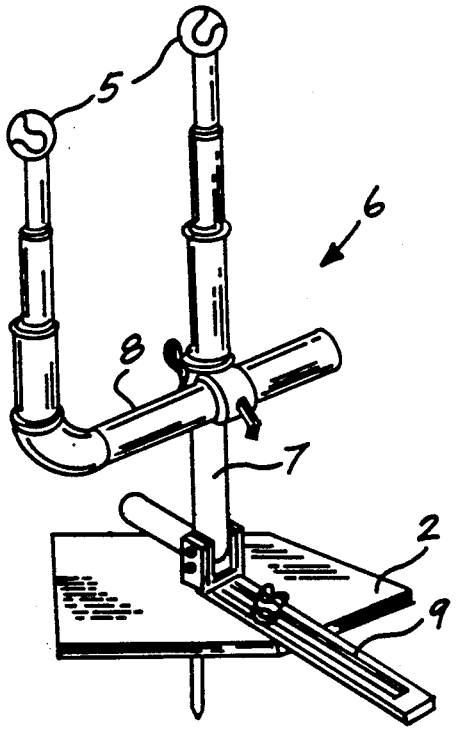
PRIOR ART FIG 2
FIG. 2 is an isometric illustration of a further example of a prior art batting tee apparatus.
Figure 3:
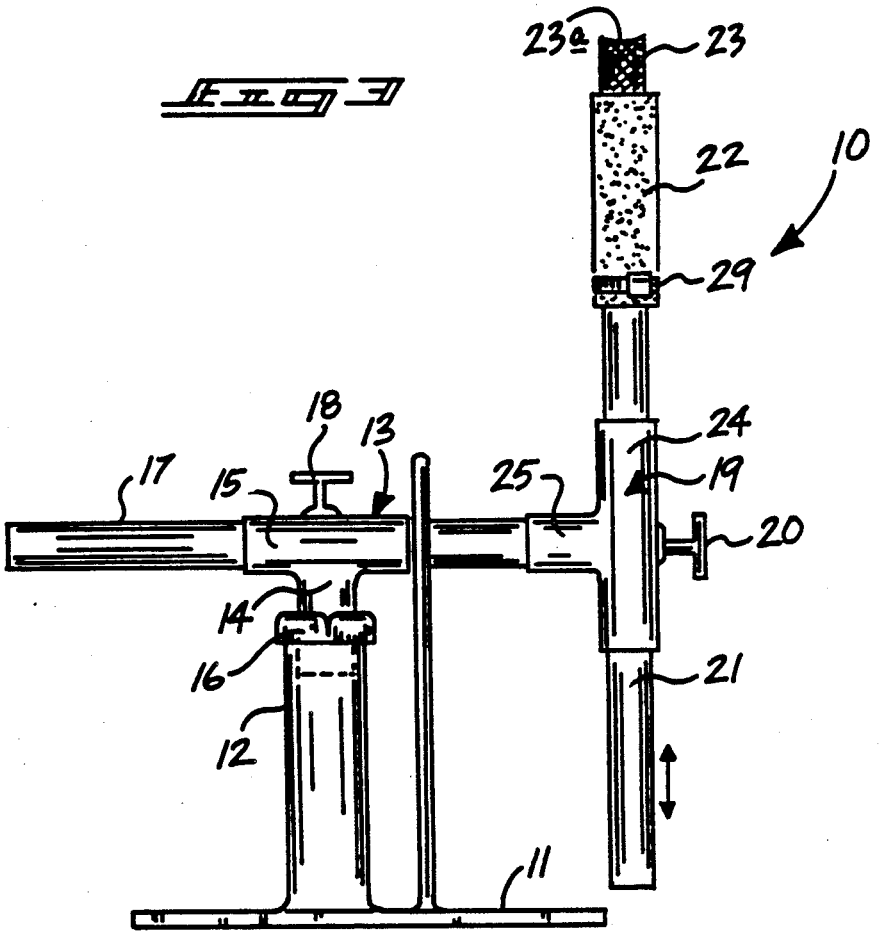
FIG. 3 is an orthographic view taken in elevation of the instant invention.
Figure 4:
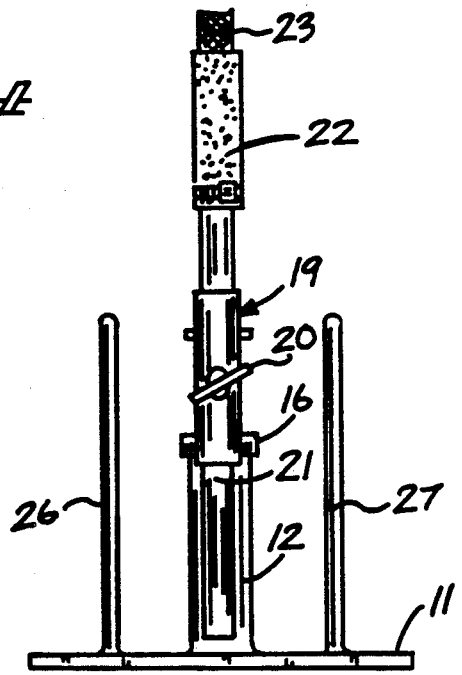
FIG. 4 is a frontal orthographic view taken in elevation of the instant invention.
Figure 5:
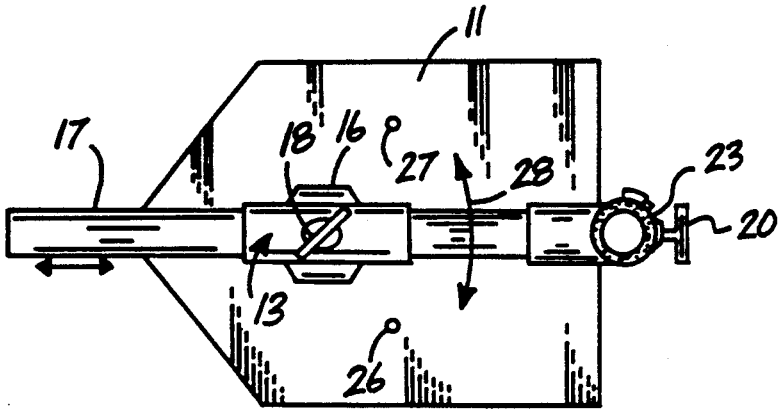
FIG. 5 is a top orthographic view of the instant invention.
Figure 7:
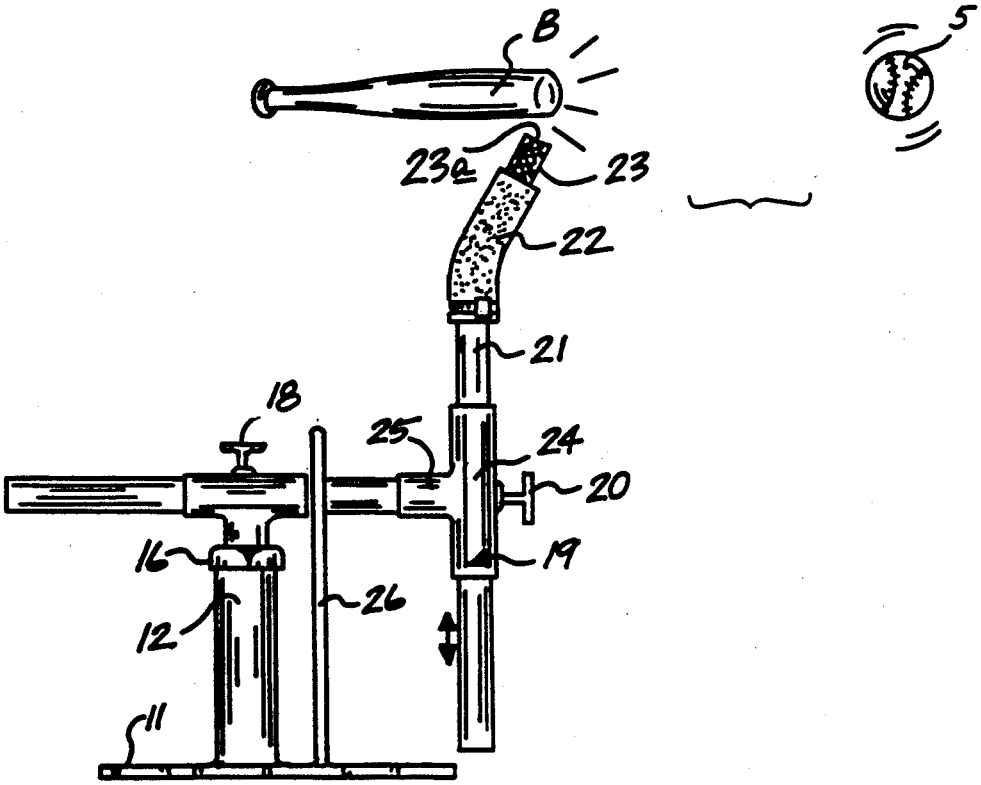
FIG. 7 is an orthographic view of the invention illustrating its use with a bat.
Figure 6:
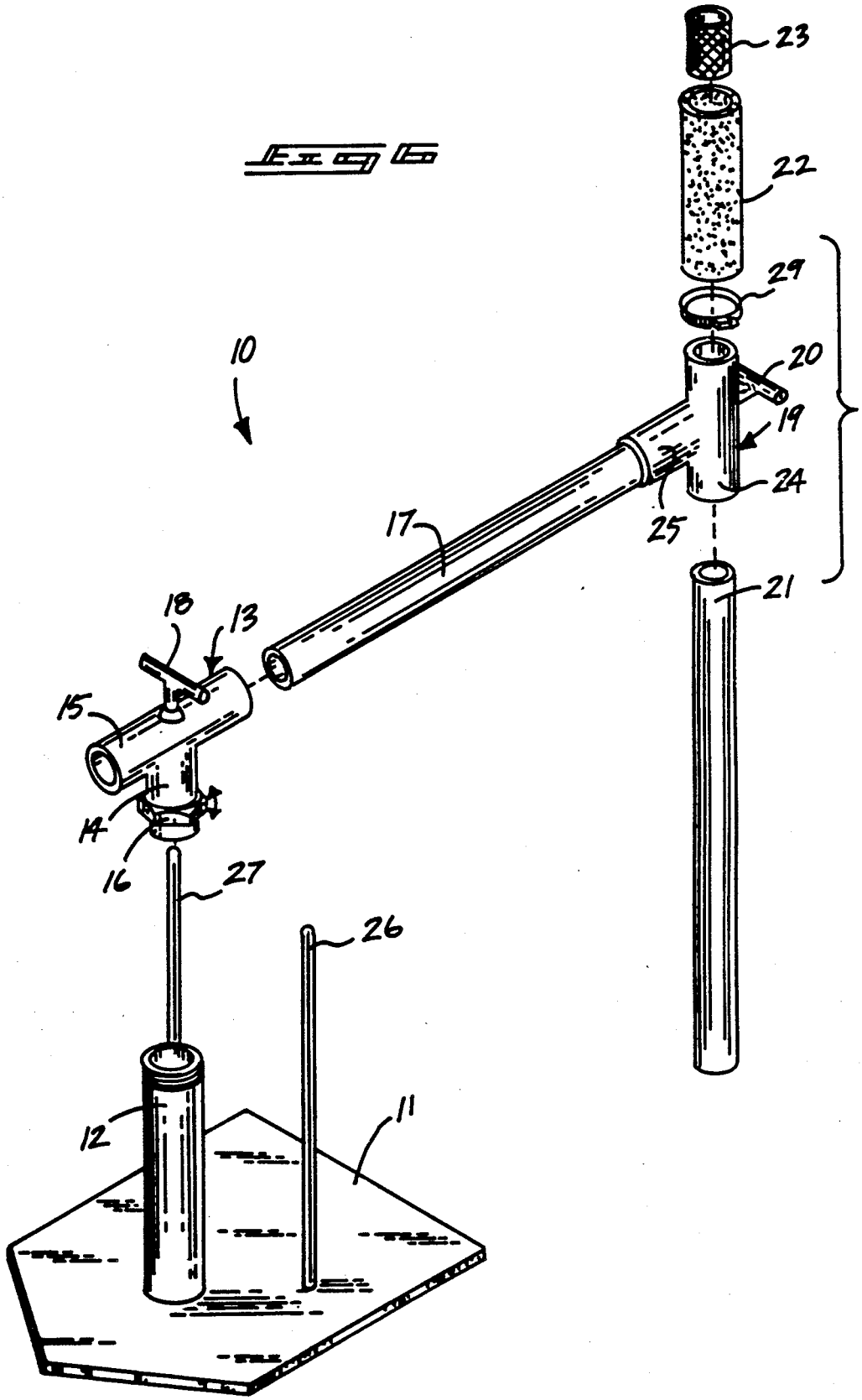
FIG. 6 is an isometric illustration of the instant invention in an exploded configuration.

FIG. 1 illustrates a prior art batting tee member 1 utilizing a "home" plate 2 formed with apertures 3 therethrough for securement of spikes to secure the plate 2 to an underlying surface. An adjustable post 4 is resiliently mounted to the plate 2 by use of a coil spring to mount a baseball 5 thereon. FIG. 2 illustrates a further prior art batting tee organization 6 wherein a main support post 7 mounted to a "home" plate 2 utilizes an "L" shaped leg member to mount a plurality of baseballs 5 to the post 7 and the "L" shaped member 8 mounted to a slide 9 to pivotally and rotatably mount the post 7 to the home plate 2.

More specifically, the adjustable batting tee 10 of the instant invention essentially comprises a support plate 11 configured as a conventional "home" plate utilized in baseball, wherein a first vertical support post 12 is integrally and orthogonally mounted to a top surface of the support plate adjacent a rear portion thereof. The first vertical support post 12 is directed upwardly and receives a first "T" shaped conduit 13 therewithin, wherein the first conduit 13 is frictionally and rotatably mounted within the first vertical support post 12 by a friction collar 16 to adjust resistance in rotation of the first "T" shaped conduit 13 relative to the support post 12. The first "T" shaped conduit 13 is defined by a vertical tube 14 bisecting a through-extending horizontal tube 15, wherein the horizontal tube 15 slidably receives a horizontal support tube 17 therethrough that is frictionally engaged in a preselected position relative to the first "T" shaped conduit 13 by a first friction clamp 18 rotatably mounted through the horizontal tube 15 to engage the horizontal support tube 17. The horizontal support tube 17 is directed forwardly and is integrally mounted and received within a second "T" shaped conduit 19. The second "T" shaped conduit 19 is defined by horizontal tube 25 fixedly receiving the forward end of the horizontal support tube 17 therewithin, wherein the horizontal tube 25 bisects orthogonally a vertically through-extending tube 24. The tube 24 includes a second friction clamp 20 rotatably mounted therethrough to frictionally engage an outer wall of a second vertical support post 21 that is slidably mounted relative to the vertical tube 24 to enable vertical adjustment of the second vertical support post 21. An upper end of the second vertical support post 21 mounts a resilient connector tube 22 thereabout, wherein the resilient connector 22 is formed of a memory retentent material that deflects to its original configuration. A clamp 29 secures the connector tube 22 to the upper end of the second vertical support post 21. A rigid mounting sleeve 23 formed with an arcuate convex upper end **23*a* is frictionally mounted interiorly of the resilient connector tube 22. The arcuate upper end 23*a* defines a surface generally orthogonally aligned to an axis defined by the rigid mounting sleeve 23. It is understood that the sleeve 23, the connector tube 22, the second vertical support post 21, and the vertical through-extending tube of the second "T" shaped conduit 19** are all coaxially aligned relative to one another.

First and second abutment rods 26 and 27 are mounted forwardly and to either side of the first vertical support post 12. The first and second abutment rods 26 and 27 are integrally and orthogonally mounted to the upper surface of the support plate 11 and are positioned to enable an arc of rotation of 120 degrees, as indicated by the arrow 28 in FIG. 5. The arc of 120 degrees, as well as the reciprocatable adjustment availability of the horizontal support tube relative to the first "T" shaped conduit 13, accommodates desired positioning of the baseball 5 onto the rigid mounting sleeve 23. Further, the second vertical support post 21 in its vertical adjustability relative to the vertical and through-extending tube 24 provides a three-dimensional adjustment of the baseball 5 in a predetermined position relative to an individual utilizing a bat "B" to strike the associated baseball 5.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimentional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An adjustable batting tee apparatus comprising, in combination, a planar support plate having upper and lower surfaces for placement of a support surface, a first follow vertical support post having an upper end said vertical support post being rigidly and orthogonally mounted to an upper surface of said support plate, and elongated horizontally extending first adjustment means having a forward end said first adjustment means being rotatably mounted on the upper end of said first vertical support post for rotative positioning of the first adjustment means relative to the first vertical support post, a second elongated vertically extending adjustment means mounted on said forward end of said first adjustment means for vertical positioning of the second adjustment means relative to the first adjustment means, the second adjustment means having an upper end, the upper end of the second adjustment means defining an arcuate convex surface for receiving a spherical baseball thereon, and first and second spaced abutment members mounted on the upper surface of the planar support plate for limiting rotative adjustment of the first adjustment means relative to the support plate.

2. An apparatus as set forth in claim 1 wherein the first adjustment means includes a first "T" shaped conduit and a horizontal support tube, the first "T" shaped conduit slidably receiving a horizontal support tube therethrough, and a first friction clamp attached to the first "T" shaped conduit to frictionally engage the horizontal support tube to frictionally secure and horizontally adjust the horizontal support tube relative to the first "T" shaped conduit.

3. An apparatus as set forth in claim 2 wherein the first vertical support post further includes a friction collar mounted on an upper end of the first vertical support post to frictionally engage the first "T" shaped conduit.

4. An apparatus as set forth in claim 3 wherein the first "T" shaped conduit includes and the other end of said first vertical tube, a first vertical tube and a first horizontal tube, said first horizontal tube being attached orthogonally to one end of said first vertical tube and the other end of said first vertical tube extending into said first vertical support tube extending into said first horizontal tube slidably receiving said horizontal support tube therethrough.

5. An apparatus as set forth in claim 4 wherein the second adjustment means includes a second "T" shaped conduit, the second "T" shaped conduit including a second horizontal tube intersecting orthogonally a second vertical tube, the second vertical tube slidably receiving a second vertical support post therethrough, and a second friction clamp extending into the second vertical tube to frictionally engage the second vertical support post and selectively secure the second vertical support post in a predetermined vertical orientation relative to the second "T" shaped conduit.

6. An apparatus as set forth in claim 5 wherein the second vertical support post includes a resilient connector tube secured to an upper end of the second vertical support post, and a rigid mounting sleeve secured within the resilient connector tube, wherein the rigid mounting sleeve defines the arcuate convex surface.

7. An apparatus as set forth in claim 6 wherein each of said first and second abutment members are spaced from said first vertical support post, each being on opposed sides hereof and extending above the first "T" shaped conduit and limit rotative adjustment of the horizontal support tube to 120 degrees.

8. An apparatus as set forth in claim 7 wherein said first and second abutment means or post, and rigidly and orthogonally mounted on the upper surface of the support plate.

* * * * *